US011332688B2

(12) United States Patent
Lin et al.

(10) Patent No.: US 11,332,688 B2
(45) Date of Patent: May 17, 2022

(54) LUBRICATING OIL OR GREASE WITH ANTI-WEAR, ANTI-FRICTION AND STABLE DISPERSION AND PREPARATION METHOD THEREOF

(71) Applicants: Guangxi Liugong Machinery Co., Ltd., Liuzhou (CN); Guangxi TengZhi Investment Co., Ltd., Liuzhou (CN)

(72) Inventors: Bo Lin, Liuzhou (CN); Jinqiong Luo, Liuzhou (CN); Li Zhang, Liuzhou (CN); Xiaona Wan, Liuzhou (CN); Mingzhi Lin, Liuzhou (CN); Wei Luo, Liuzhou (CN); Zhiheng Feng, Liuzhou (CN); Hong Chen, Liuzhou (CN)

(73) Assignees: GUANGXI LIUGONG MACHINERY CO., LTD., Liuzhou (CN); GUANGXI TENGZHI INVESTMENT CO., LTD., Liuzhou (CN)

( * ) Notice: Subject to any disclaimer, the term of this patent is extended or adjusted under 35 U.S.C. 154(b) by 0 days.

(21) Appl. No.: 17/371,443

(22) Filed: Jul. 9, 2021

(65) Prior Publication Data

US 2022/0010227 A1 Jan. 13, 2022

(30) Foreign Application Priority Data

Jul. 13, 2020 (CN) ..... 202010670619.9

(51) Int. Cl.
*C10M 135/10* (2006.01)
*C10M 169/00* (2006.01)
(Continued)

(52) U.S. Cl.
CPC ..... *C10M 135/10* (2013.01); *C10M 169/00* (2013.01); *C10M 177/00* (2013.01);
(Continued)

(58) Field of Classification Search
CPC ..... C10M 135/10; C10M 169/00; C10M 177/00; C10M 2203/003; C10M 2219/044;
(Continued)

(56) References Cited

U.S. PATENT DOCUMENTS

2012/0032543 A1 2/2012 Chakraborty et al.
2014/0212587 A1* 7/2014 Malshe ..... C10M 169/042 427/331

FOREIGN PATENT DOCUMENTS

CN 101812351 A 8/2010
CN 106190432 A 12/2016
(Continued)

OTHER PUBLICATIONS

Chinese Office Action dated Sep. 15, 2021 in connection with Chinese Patent Application No. 202010670619.9.
(Continued)

*Primary Examiner* — Prem C Singh
*Assistant Examiner* — Francis C Campanell
(74) *Attorney, Agent, or Firm* — Amster, Rothstein & Ebenstein LLP

(57) ABSTRACT

The present disclosure relates to an anti-wear, anti-friction and stably-dispersed lubricating oil or grease, and the anti-wear, anti-friction and stably-dispersed lubricating oil or grease includes a main component of a lubricating oil or grease and a long carbon chain-grafted sulfonated graphene, the preparation method of which includes mixing a main component of a lubricating oil or grease with a long carbon chain-grafted sulfonated graphene, stirring and dispersing the mixture to obtain the product. The lubricating oil or grease in the present disclosure can significantly improve the long-term dispersion stability and dispersion stability in a complex environment by adding a long carbon chain-grafted sulfonated graphene in the main component, and at the same
(Continued)

time can significantly improve the friction coefficient, which can significantly improve the anti-wear and anti-friction properties of the lubricating oil or grease, reduce the diameter of wear scars, and reduce the wear of copper and iron.

10 Claims, 2 Drawing Sheets

(51) Int. Cl.

| | |
|---|---|
| ***C10M 177/00*** | (2006.01) |
| *C10N 30/06* | (2006.01) |
| *C10N 40/04* | (2006.01) |
| *C10N 40/08* | (2006.01) |
| *C10N 40/25* | (2006.01) |
| *C10N 50/10* | (2006.01) |

(52) U.S. Cl.
CPC . *C10M 2203/003* (2013.01); *C10M 2219/044* (2013.01); *C10N 2030/06* (2013.01); *C10N 2040/04* (2013.01); *C10N 2040/08* (2013.01); *C10N 2040/25* (2013.01); *C10N 2050/10* (2013.01)

(58) Field of Classification Search
CPC ..... C10N 2030/06; C10N 2040/04; C10N 2040/08; C10N 2040/25; C10N 2050/10
USPC ..... 508/403
See application file for complete search history.

(56) References Cited

FOREIGN PATENT DOCUMENTS

| | | | |
|---|---|---|---|
| CN | 106467767 | A | 3/2017 |
| CN | 106867630 | A | 6/2017 |
| CN | 107236581 | A | 10/2017 |
| CN | 107312600 | A | 11/2017 |
| CN | 107739643 | A | 2/2018 |
| CN | 108793792 | A | 11/2018 |
| CN | 109456827 | A | 3/2019 |
| CN | 109486547 | A | 3/2019 |
| CN | 109810748 | A | 5/2019 |
| CN | 109943384 | A | 6/2019 |
| CN | 110106007 | A | 8/2019 |

OTHER PUBLICATIONS

Machine-Assisted English abstract of CN109810748A, downloaded from Espacenet.com on Mar. 11, 2022; 17 pages.
Machine-Assisted English abstract of CN110106007A, downloaded from Espacenet.com on Mar. 11, 2022; 19 pages.
Fu Xiuli et al., "Friction-reducing, anti-wear and self-repairing properties of sulfonated graphene", Wuhan University of Technology; vol. 32, No. 2, May 3, 2017; pp. 272-277; XP036228295.
Tong Yu et al.; "Suspension Dispersibility and Tribological Properties of Graphene-modified Lubricant Oil", Chinese Journal of Materials Research, vol. 33, Jan. 1, 2019; pp. 59-64; XP055862847, DOI: 10.11901/1005.3093.2017.798.
European Search Report for European Application No. EP21183340.5, dated Nov. 26, 2021; 28 pages.

* cited by examiner

LUBRICATING OIL OR GREASE WITH ANTI-WEAR, ANTI-FRICTION AND STABLE DISPERSION AND PREPARATION METHOD THEREOF

CROSS-REFERENCE TO RELATED APPLICATIONS

This application claims priority to Chinese Patent Application No. 202010670619.9, filed on Jul. 13, 2020, the contents of which are incorporated herein in its entirety by reference.

TECHNICAL FIELD

The present disclosure belongs to the technical field of modified lubricating oils, and specifically relates to a lubricating oil or grease and a preparation method thereof, in particular to a lubricating oil or grease that is anti-wear, anti-friction and stable in dispersion, and a preparation method thereof.

BACKGROUND

Friction and wear are common in nature, and friction and wear are one of the main reasons for the scrap of materials and equipments. Therefore, people use various methods including lubricating oils or greases to reduce friction and wear. In order to improve the lubricating performance of lubricating oils or greases, new additives are often introduced into the lubricating oils or greases. At present, there are two main categories of anti-wear and anti-friction additives, one is oil-soluble additives, such as oily agents containing polar groups, fatty acids, fatty acid esters, organic amines, amide esters, imide compounds, sulfurized fat, phosphorus-containing compounds, chlorine-containing compounds, boric acid ester, borates, organometallic compounds, organomolybdenum compounds, etc., and the other is solid additives, especially graphite with a special lamellar structure, molybdenum disulfide, tungsten disulfide, boron nitride, etc.

Graphene has a two-dimensional structure and is the thinnest nanomaterial known so far, with a specific surface area as high as 2630 $m^2/g$, and outstanding thermal, electrical and mechanical properties. These characteristics make graphene have excellent lubrication, wear resistance, thermal conductivity, oxidation resistance, corrosion resistance and stability when used as a solid additive for lubricating oils, which is significantly better than other existing anti-wear additives for lubricating oils. The lamellar structure of graphene makes it extremely easy to form a uniform and firmly-adherent film on the contact surfaces of moving parts, thereby reducing direct wear on the parts, and its good thermal conductivity helps prevent local hot spots at friction interfaces, thereby prolonging the life of the lubricating oils.

CN107739643A discloses a lubricating oil containing surface-modified carbon nanomaterials and a preparation method thereof. Graphene, carbon nanotubes and carbon nanofibers are respectively coated with polydopamine on the surface and grafted with long carbon alkanes to obtain corresponding modified carbon nanomaterials. The modified carbon nanomaterials, a base oil, and other functional additives for lubricating oils are mixed in proportion to obtain a lubricating oil containing surface-modified carbon nanomaterials, which solves the problems of stability and dispersibility, and produces a ball effect and a support effect, and thus significantly improves the performances of the lubricating oil. However, the dispersion stability of the product standing for 180 days does not meet the stability requirements of practical applications.

Lubricating oils or greases containing solid lubricating additive particles have been effective in practical applications, but there are still many technical problems in such lubricating oils or greases that require in-depth study. For example, the problem that additives improve the comprehensive friction performance of lubricating oils or greases. For example, the problem of suspension stability when the additive is uniformly dispersed in the lubricating oil or grease, placed for a long time and placed in a complex environment. If the additive is not sufficiently dispersed in the lubricating oil, but exists as a large number of agglomerates, on the one hand, it tends to settle under gravity, and on the other hand, its effect on lubrication performance enhancement is significantly reduced.

CN109486547A discloses a sulfurized graphene and a preparation method and an application thereof. The specific method is to first use potassium permanganate and concentrated sulfuric acid to oxidize graphene, and then use $P_4S_{10}$ to vulcanize the oxidized graphene to prepare sulfurized graphene. Under simulated working conditions, the tribological properties of the graphene reaction lubricating film are tested and the lubrication mechanism is investigated. The results show that the dispersibility of graphene can be improved by vulcanization, and the anti-wear and anti-friction effect of graphene can be improved. However, the absorbance shows that the absorbance decreases from 1 Abs to 0.4 Abs or less after 100 h, and the absorbance decreases by 50% or more. The stability of the product when dispersed in synthetic oil is still poor.

CN106467767A discloses a method for preparing microcrystalline graphene, which includes: using a mixture of $NaNO_3$, $KMnO_4$ and concentrated sulfuric acid to oxidize microcrystalline graphite; and calcining the oxidized microcrystalline graphite in the presence of hydrogen. The lubricating performance can be significantly improved by adding a very small amount of microcrystalline graphene to the lubricating oil. CN109943384A discloses a graphene anti-wear hydraulic oil, and the composition of the raw materials is as follows (in parts by weight): a base oil: 90-98 parts; an antioxidant: 0.1-5 parts; modified graphene oxide: 1-5 parts; a rust inhibitor: 0.1-5 parts; an anti-foaming agent: 0.001-0.1 parts. This product improves the dispersion performance of graphene in the base oil, and obtains a graphene hydraulic oil with high stability, and much better anti-friction and anti-wear effect than traditional anti-wear hydraulic oils.

However, the current prior art usually only uses four-ball method to evaluate the friction coefficient, only the dynamic friction coefficient, which is not very relevant to the actual application conditions, and it is not known whether the comprehensive friction performance for the actual application is good.

SUMMARY

In view of the deficiencies of the existing art, the present disclosure aims to provide a lubricating oil or grease and a preparation method thereof, in particular, a lubricating oil or grease with anti-wear, anti-friction and stable dispersion and a preparation method thereof. The lubricating oil or grease can achieve long-term dispersion stability and dispersion stability in a complex environment, and while reducing the endpoint friction coefficient/midpoint friction coefficient, the static friction coefficient can meet the industry standard requirements and does not reduce the traction force of the complete machine, with significant operating comfortability.

To achieve this object, the present disclosure adopts technical solutions described below.

In one aspect, the present disclosure provides an anti-wear, anti-friction and stably-dispersed lubricating oil or grease. The anti-wear, anti-friction and stably-dispersed lubricating oil or grease includes a main component of a lubricating oil or grease and a sulfonated graphene grafted with long carbon chain.

For the lubricating oil or grease involved in the present disclosure, for the first time, the long-term dispersion stability and the dispersion stability in a complex environment are remarkably improved by adding a sulfonated graphene grafted with long carbon chain to the main component. There is basically no precipitation when it is left standing at room temperature for 1 year, there is basically no precipitation when it is left for 24 hours at 120° C., and there is basically no precipitation when it is left for 24 hours in an environment with alternating high and low temperatures for 24 hours. The friction coefficient can be significantly improved by adding a sulfonated graphene grafted with long carbon chain in the main component. The present disclosure not only studies the four-ball friction coefficient, the reduction value of which exceeds 22% under high load (100 kgf), but also studies the endpoint friction coefficient, midpoint friction coefficient, and torque curve through SAE No. 2. The results show that the ratio of the endpoint friction coefficient to the midpoint friction coefficient is significantly reduced, and the static friction coefficient can meet the requirements of the industry standard without reducing the traction force of the complete machine, which has significant operating comfortability. By adding a sulfonated graphene grafted with long carbon chain to the main component, the anti-wear and anti-friction properties of the lubricating oil or grease can be significantly improved, the diameter of wear spots and the wear of copper and iron are reduced.

The sulfonated graphene grafted with long carbon chain in the present disclosure is a new functionalized modified graphene derivative product. The preparation method comprises firstly subjecting graphene or graphene oxide to sulfonation treatment, and then subjecting the sulfonated graphene to long-carbon-chain grafting reaction modification, or directly subjecting the sulfonated graphene to long-carbon-chain grafting modification to obtain the final product. The specific preparation strategy can be based on the basic organic synthesis mechanism and conventional modification methods known to the skilled person in the field, and the present disclosure does not limit the preparation method, and the nature of the final product is not affected by the preparation method. Various methods of graphene surface modification have been reported in the prior art, and will not be described in detail here.

The above-mentioned long carbon chain may be selected from substituted or unsubstituted alkyl straight chain or alkyl branched chain.

Preferably, the mass ratio of carbon element to sulfur element in the sulfonated graphene grafted with long carbon chain is 15-50, such as 15, 16, 20, 23, 25, 28, 30, 32, 35, 40 or 50, etc. Any specific point value within the above numerical range can be selected, and will not be repeated here.

The mass ratio of carbon element to sulfur element in the sulfonated graphene grafted with long carbon chain is a key factor affecting the dispersion stability and anti-wear and anti-friction properties of the lubricating oil or grease in the present disclosure.

Preferably, the number of carbon atoms in the long carbon chain of the sulfonated graphene grafted with long carbon chain is 10-50, such as 10, 15, 20, 22, 24, 25, 26, 27, 28, 30, 40 or 50.

The number of carbon atoms in the long carbon chain of the sulfonated graphene grafted with long carbon chain is also a key factor that affects the dispersion stability and anti-wear and anti-friction properties of the lubricating oil or grease in the present disclosure. As the carbon number distribution of the base oil of the lubricating oil or grease is roughly 20-40 carbon atoms, the greater the deviation of the carbon atom number of the long carbon chain from that of the base oil, the worse the dispersion effect of the modified graphene will be, thus it is difficult to play the anti-wear and anti-friction role stably.

The present disclosure limits the mass ratio of carbon element to sulfur element and the number of carbon atoms in the long carbon chain to the above-mentioned value ranges, i.e., it determines an optimal microstructure form that can optimize the dispersion stability performance and anti-wear and anti-friction properties of the lubricating oil or grease.

Preferably, the sulfonated graphene grafted with long carbon chain is added to the anti-wear, anti-friction and stably-dispersed lubricating oil or grease by a mass of 0.001-1%, such as 0.001%, 0.01%, 0.05%, 0.1%, 0.2%, 0.3%, 0.4%, 0.5%, 0.6%, 0.7%, 0.8%, 0.9% or 1%, etc. Any specific point value within the above numerical range can be selected, and will not be repeated here.

The present disclosure limits the addition range of the sulfonated graphene grafted with long carbon chain in the anti-wear, anti-friction and stably-dispersed lubricating oil or grease to 0.001-1%. Too much addition will affect other additives in the lubricating oil or grease to play a role; too little addition will not achieve the desired anti-wear and anti-friction effect.

Preferably, the main component of a lubricating oil includes a hydraulic transmission oil, a hydraulic oil, a gear oil or an engine oil.

The main component of a lubricating oil in the present disclosure includes a base oil and an additive, and the base oil may be a paraffin-based base oil, an intermediate base oil or a naphthenic base oil. The additive may be a viscosity index improver, a pour point depressant, an antioxidant, a detergent, a dispersant, a friction modifier, an oily agent, an extreme pressure agent, an antifoaming agent, a metal deactivator, an emulsifier, an anticorrosive, a rust inhibitor, a demulsifier or an antioxidant and anticorrosive agent, etc.

Preferably, the hydraulic transmission oil is No. 8 hydraulic transmission oil or automatic transmission oil.

Preferably, the hydraulic oil is HM-46 hydraulic oil.

The research of the present disclosure found that the specific types of hydraulic transmission oil or hydraulic oil mentioned above has a better matching relationship with the sulfonated graphene grafted with long carbon chain in the present disclosure, and the latter can significantly enhance the anti-wear and anti-friction properties and dispersion stability of the former.

Preferably, the main component of a lubricating grease includes a calcium-based lubricating grease, a lithium-based lubricating grease, a complex lithium-based lubricating grease, a complex calcium-based lubricating grease, a polyurea, a silicone grease, or a fluorine grease.

The main component of a lubricating grease in the present disclosure includes a base oil, an additive and a thickener, and the base oil may be a paraffin-based base oil, an intermediate base oil or a naphthenic base oil. The additive may be a viscosity index improver, a pour point depressant, an antioxidant, a detergent, a dispersant, a friction modifier, an oily agent, an extreme pressure agent, an antifoaming agent, a metal deactivator, an emulsifier, an anticorrosive, a rust inhibitor, a demulsifier or an antioxidant and anticorrosive agent, etc.

In another aspect, the present disclosure provides a method for preparing the above-mentioned anti-wear, anti-friction and stably-dispersed lubricating oil or grease, and the preparation method includes:

(1) dispersing a sulfonated graphene grafted with long carbon chain in a base oil to produce a graphene additive; and (2) mixing the graphene additive produced in step (1) with a main component of a lubricating oil or grease, stirring and dispersing the mixture to obtain an anti-wear, anti-friction and stably-dispersed lubricating oil or grease.

The base oil of step (1) is consistent with the base oil of the main component of a lubricating oil or grease in step (2).

Preferably, the mass fraction of the sulfonated graphene grafted with long carbon chain in the graphene additive in step (1) is 0.1-10%, for example, 0.1%, 1%, 2%, 5%, 8%, or 10%, etc. Any specific point value within the above numerical range can be selected, and will not be repeated here.

Preferably, the dispersion process in step (1) includes stirring dispersion or pulse dispersion, the dispersion time is 10-60 min (for example, 10 min, 30 min, 40 min or 60 min, etc.), and the stirring speed is 10-6000 r/min (for example, 10 r/min, 500 r/min, 1000 r/min, 3000 r/min, 4000 r/min, or 6000 r/min, etc.).

Preferably, the dispersion in step (2) includes stirring dispersion, pulse dispersion or grinding dispersion, the dispersion time is 0.1-3 h (for example, 0.1 h, 0.2 h, 0.5 h, 0.8 h, 1 h, 2 h or 3 h, etc.), and the stirring speed is 10-3000 r/min (for example, 10 r/min, 50 r/min, 80 r/min, 100 r/min, 200 r/min, 300 r/min, 500 r/min, 1000 r/min, 2000 r/min, or 3000 r/min, etc.).

Compared with the existing art, the present application has beneficial effects described below.

(1) For the lubricating oil or grease involved in the present disclosure, the long-term dispersion stability and the dispersion stability in a complex environment are remarkably improved by adding a sulfonated graphene grafted with long carbon chain to the main component. There is basically no precipitation when it is left standing at room temperature for 1 year, there is basically no precipitation when it is left for 24 hours at 120° C., and there is basically no precipitation when it is left for 24 hours in an environment with alternating high and low temperatures for 24 hours.

(2) In the present disclosure, the friction coefficient can be significantly improved by adding a sulfonated graphene grafted with long carbon chain to the main component of a lubricating oil or grease. The present disclosure not only studies the four-ball friction coefficient, the reduction value of which exceeds 22% under high load (100 kgf), but also studies the endpoint friction coefficient, midpoint friction coefficient, and torque curve through SAE No. 2. The results show that the ratio of the endpoint friction coefficient to the midpoint friction coefficient is significantly reduced, and the static friction coefficient can meet the requirements of the industry standard without reducing the traction force of the complete machine, and it has significant operating comfortability.

(3) The present disclosure can significantly improve the anti-wear and anti-friction properties of the lubricating oil or grease by adding long carbon chain-grafted sulfonated graphene in the main component of a lubricating oil or grease, reduce the diameter of wear spots, and reduce the wear of copper and iron.

DETAILED DESCRIPTION

Figure 1:
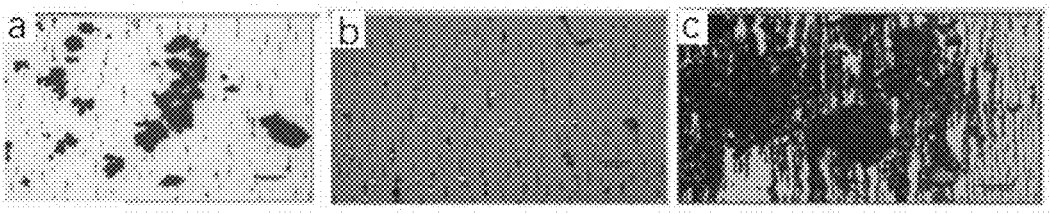
FIG. 1 is analytical ferrographs of the products of Example 1, Comparative Example 2 and Comparative Example 4 (a, b, and c respectively correspond to the products of Example 1, Comparative Example 2, and Comparative Example 4, and the scale is 100 μm)

The technical solutions of the present disclosure are further described below by means of specific embodiments. It should be clear to those skilled in the art that the described examples are only to aid in the understanding of the present disclosure and should not be considered as specific limitations of the present disclosure.

The preparation materials in the following examples can be prepared by methods disclosed in the prior art or obtained through commercial purchases unless otherwise specified.

Example 1

The present example provides a hydraulic oil with anti-wear, anti-friction and dispersion stability performances, which is HM-46 hydraulic oil added with a linear docosyl-grafted sulfonated graphene. Wherein, the added mass of the linear docosyl-grafted sulfonated graphene is 0.03% of HM-46 hydraulic oil; the mass ratio of elemental carbon to elemental sulfur of the linear docosyl-grafted sulfonated graphene is 23.

The preparation method is:

(1) stirring and dispersing a linear docosyl-grafted sulfonated graphene in a base oil of HM-46 hydraulic oil at a temperature of 30° C. to prepare a graphene additive, the mass fraction of the linear docosyl-grafted sulfonated graphene is 5%, the dispersion time is 20 min, and the stirring speed is 3000 r/min; and (2) mixing the graphene additive prepared in step (1) with HM-46 hydraulic oil, stirring and dispersing at 100 r/min for 40 min to obtain the anti-wear, anti-friction and stably-dispersed hydraulic oil.

Example 2

The present example provides a transmission oil with anti-wear, anti-friction and dispersion stability performances, which is No. 8 hydraulic transmission oil added with a linear docosyl-grafted sulfonated graphene. Wherein, the added mass of the linear docosyl-grafted sulfonated graphene is 0.02% of No. 8 transmission oil; the mass ratio of elemental carbon to elemental sulfur of the linear docosyl-grafted sulfonated graphene is 23.

The preparation method is:

(1) performing pulse dispersion of the linear docosyl-grafted sulfonated graphene in a base oil of No. 8 hydraulic transmission oil at a temperature of 30° C. to prepare a graphene additive, the mass fraction of the linear docosyl-grafted sulfonated graphene is 5%, the dispersion time is 20 min, and the stirring speed is 3000 r/min; and (2) mixing the graphene additive prepared in step (1) with No. 8 hydraulic transmission oil, and pulse dispersing at 100 r/min for 40 min to obtain the anti-wear, anti-friction and stably-dispersed hydraulic transmission oil.

Examples 3-10

The present examples provide eight types of hydraulic oils with anti-wear, anti-friction and dispersion stability performances, which are HM-46 hydraulic oils added with a long carbon chain-grafted sulfonated graphene. In Examples 3-10, the mass ratios of carbon element and sulfur element in the long carbon chain-grafted sulfonated graphene are 10, 15, 17, 19, 25, 30, 35, and 40 in order. The preparation methods refer to the method in Example 1.

Example 11

The present example provides a hydraulic oil with anti-wear, anti-friction and dispersion stability performances, which is HM-22 hydraulic oil added with a linear docosyl-grafted sulfonated graphene. The characteristics of the linear docosyl-grafted sulfonated graphene are consistent with those of Example 1. The preparation method is also consistent with Example 1.

Example 12

The present example provides a transmission oil with anti-wear, anti-friction and dispersion stability performances, which is No. 6 hydraulic transmission oil added with a linear docosyl-grafted sulfonated graphene. The characteristics of the linear docosyl-grafted sulfonated graphene are consistent with those of Example 2. The preparation method is also consistent with Example 1.

Comparative Example 1

The present Comparative Example provides a hydraulic oil, which is HM-46 hydraulic oil added with graphene powder (the model is G-Powder, the manufacturer is Ningbo Morsh Technology Co., Ltd.). Wherein, the added mass of the graphene powder is 0.03% of the HM-46 hydraulic oil. The preparation method refers to Example 1.

Comparative Example 2

The present Comparative Example is HM-46 hydraulic oil without any additives.

Comparative Example 3

The present Comparative Example provides a hydraulic transmission oil, which is No. 8 hydraulic transmission oil added with graphene powder (the model is G-Powder, the manufacturer is Ningbo Morsh Technology Co., Ltd.). Wherein, the added mass of the graphene powder is 0.02% of No. 8 hydraulic transmission oil. The preparation method refers to Example 2.

Comparative Example 4

The present Comparative Example is No. 8 hydraulic transmission oil without any additives.

Evaluation Tests:

(1) Evaluation of Dispersion Stability

The products of Examples 1-12 and Comparative Examples 1 and 3 are evaluated for dispersion stability in the following aspects, and the transmittances of each group of products are tested with LUMISizer@651. The principle is: if the dispersion stability of the product is not good, it will sink down to the end of the colorimetric tube, and the main test position of the transmittance is the middle of the colorimetric tube; if the graphene sinks, the transmittance will become higher, indicating worse stability.

(1.1) 50 mL of each group of products are centrifuged at 6000 rpm for 10 min at 25° C. using a centrifuge (Xiangyi H1850) and the transmittances are calculated and the results are shown in Table 1;

(1.2) 50 mL of each group of products are allowed to stand at 25° C. for 1 year and the transmittances are calculated and the results are shown in Table 1;

(1.3) 50 mL of each group of products are allowed to stand at 25° C. for 24 h and the transmittances are calculated and the results are shown in Table 1; and (1.4) 50 mL of each group of products are allowed to an alternating high and low temperature cycling procedure for 24 h and the transmittances are calculated, in which the alternating high and low temperature cycling procedure is shown in the table below, and the results are shown in Table 1.

| Step | Starting temperature/° C. | Target temperature/° C. | Temperature rising/falling time/min | Holding time after reaching the target temperature/min |
|---|---|---|---|---|
| 1 | 25 | −20 | 50 | 90 |
| 2 | −20 | 0 | 20 | 90 |
| 3 | 0 | 20 | 20 | 90 |
| 4 | 20 | 40 | 20 | 90 |
| 5 | 40 | 60 | 20 | 90 |
| 6 | 60 | 80 | 20 | 90 |
| 7 | 80 | 100 | 20 | 90 |
| 8 | 100 | 120 | 20 | 90 |
| 9 | 120 | −20 | 140 | 90 |

After completing step 9, repeat steps 2-9

TABLE 1

| Group | (1.1) | (1.2) | (1.3) | (1.4) |
|---|---|---|---|---|
| Example 1 | 8% | 7% | 2% | 1% |
| Example 2 | 7% | 6% | 2% | 1% |
| Example 3 | 30% | 28% | 10% | 5% |
| Example 4 | 25% | 22% | 8% | 5% |
| Example 5 | 22% | 19% | 7% | 4% |
| Example 6 | 10% | 8% | 5% | 3% |
| Example 7 | 10% | 9% | 5% | 2% |
| Example 8 | 15% | 14% | 8% | 3% |
| Example 9 | 23% | 19% | 8% | 5% |
| Example 10 | 25% | 20% | 10% | 5% |

TABLE 1-continued

| Group | (1.1) | (1.2) | (1.3) | (1.4) |
|---|---|---|---|---|
| Example 11 | 10% | 8% | 3% | 2% |
| Example 12 | 8% | 7% | 3% | 2% |
| Comparative Example 1 | 42% | 42% | 30% | 25% |
| Comparative Example 3 | 38% | 38% | 29% | 23% |

Since there is a certain period of lubricating oils from production to customer use, the longer the lubricating oil can stand without precipitation, the better; at the same time, the working conditions of construction machinery are very harsh, and in the north, construction machinery may work in an environment of −20° C., requiring the minimum use temperature of lubricating oils to reach −20° C. and the maximum use temperature up to 120° C., so in addition to static stability, the present disclosure also adds the evaluation of high and low temperature alternating performance and high temperature performance. From the results in Table 1, it can be seen that the lubricating oil or grease in the present disclosure has good dispersion stability compared with the products in the Comparative Examples 1 and 3, and the mass ratio of elemental carbon to elemental sulfur in the long carbon chain-grafted sulfonated graphene significantly affects the dispersion stability of the final product, which is better when the mass ratio is 16-32.

(2) Evaluation of Friction Coefficient

The friction coefficients of the products of Examples 1-12 and Comparative Examples 1-4 are evaluated in the following aspects:

(2.1) A four-ball testing machine SH/T 0762-2005 is used to test the coefficients of dynamic friction of each group of products. The upper steel ball is operated in 600 r/min, and the lower steel ball is fixed. The load is added from the bottom to the top. The initial load is 10 kgf, which is increased by 10 kgf after every 10 min, and so on, and the total is 10 levels. The results are shown in Table 2.

TABLE 2

| Load/kgf | 10 | 20 | 30 | 40 | 50 | 60 | 70 | 80 | 90 | 100 |
|---|---|---|---|---|---|---|---|---|---|---|
| Example 1 | 0.056 | 0.083 | 0.093 | 0.094 | 0.102 | 0.1 | 0.096 | 0.101 | 0.102 | 0.098 |
| Example 2 | 0.097 | 0.102 | 0.109 | 0.114 | 0.115 | 0.113 | 0.11 | 0.108 | 0.106 | 0.101 |
| Example 3 | 0.119 | 0.11 | 0.112 | 0.115 | 0.118 | 0.119 | 0.119 | 0.118 | 0.121 | — |
| Example 4 | 0.125 | 0.107 | 0.102 | 0.106 | 0.11 | 0.113 | 0.119 | 0.12 | 0.129 | — |
| Example 5 | 0.119 | 0.107 | 0.115 | 0.116 | 0.119 | 0.122 | 0.126 | 0.131 | 0.126 | 0.124 |
| Example 6 | 0.079 | 0.086 | 0.092 | 0.101 | 0.104 | 0.105 | 0.105 | 0.107 | 0.111 | 0.110 |
| Example 7 | 0.097 | 0.093 | 0.107 | 0.102 | 0.099 | 0.099 | 0.096 | 0.093 | 0.106 | 0.105 |
| Example 8 | 0.093 | 0.099 | 0.117 | 0.119 | 0.121 | 0.122 | 0.120 | 0.118 | 0.119 | 0.118 |
| Example 9 | 0.147 | 0.137 | 0.133 | 0.133 | 0.132 | 0.128 | 0.123 | 0.117 | 0.113 | 0.123 |
| Example 10 | 0.12 | 0.108 | 0.107 | 0.114 | 0.12 | 0.119 | 0.117 | 0.118 | 0.12 | — |
| Example 11 | 0.086 | 0.092 | 0.122 | 0.116 | 0.117 | 0.118 | 0.115 | 0.109 | 0.106 | 0.105 |
| Example 12 | 0.086 | 0.103 | 0.113 | 0.114 | 0.117 | 0.118 | 0.119 | 0.117 | 0.12 | 0.119 |
| Comparative Example 1 | 0.125 | 0.107 | 0.102 | 0.106 | 0.11 | 0.113 | 0.119 | 0.12 | 0.129 | — |
| Comparative Example 2 | 0.089 | 0.108 | 0.118 | 0.121 | 0.123 | 0.122 | 0.114 | 0.111 | 0.114 | 0.132 |
| Comparative Example 3 | 0.139 | 0.137 | 0.136 | 0.135 | 0.133 | 0.13 | 0.132 | 0.129 | 0.127 | — |
| Comparative Example 4 | 0.127 | 0.116 | 0.122 | 0.124 | 0.123 | 0.127 | 0.128 | 0.127 | 0.127 | 0.125 |

From the results in Table 2, it can be seen that the improvement effect of the friction coefficient of the lubricating oil involved in the present disclosure is more obvious under high load (60 kgf-100 kgf) compared with the products of Comparative Examples 1-4, and the friction coefficient fluctuates less under full load 10 kgf-100 kgf, indicating that the lubricating oil can run smoothly under different working conditions and the customer experience (comfortability) is better. Meanwhile, the mass ratio of elemental carbon to elemental sulfur in the long carbon chain-grafted sulfonated graphene significantly affects the coefficient of dynamic friction of the final product.

(2.2) A SAE No. 2 testing machine (test method: changed according to SAE J2490) is used to test the starting/midpoint/end friction coefficient, torque curve and coefficient of static friction at 4.37 rpm for each group of products. The test procedure is shown in the table below. The test procedure is divided into 16 stages, indicated by A/B . . . P respectively; each stage is engaged 250 times with an oil temperature of 90° C., a pressure of 433 kPa and a rotational speed of 2500 rpm; at the end of each test stage, the coefficient of static friction is supplemented with a test condition of an oil temperature of 90° C., a pressure of 433 kPa-439 kPa and a rotational speed of 4.37 rpm.

| | | A | B | C | D | E | F | G | H | I | J | K | L | M | N | O | P |
|---|---|---|---|---|---|---|---|---|---|---|---|---|---|---|---|---|---|
| Standard procedure | Engagement times | 25 | 25 | 25 | 25 | 25 | 25 | 25 | 25 | 25 | 25 | 25 | 25 | 25 | 25 | 25 | 25 |
| | Oil temperature/° C. | 50 | 50 | 50 | 50 | 110 | 110 | 110 | 110 | 110 | 110 | 110 | 110 | 50 | 50 | 50 | 50 |
| | Pressure/kPa | 83 | 83 | 166 | 166 | 83 | 83 | 166 | 166 | 248 | 248 | 373 | 373 | 248 | 248 | 373 | 373 |
| | Rotational speed/rpm | 750 | 1500 | 750 | 1500 | 750 | 1500 | 750 | 1500 | 2700 | 3500 | 2700 | 3500 | 2700 | 3500 | 2700 | 3500 |
| The procedure of the present application | Engagement times | 250 | 250 | 250 | 250 | 250 | 250 | 250 | 250 | 250 | 250 | 250 | 250 | 250 | 250 | 250 | 250 |
| | Oil temperature/° C. | 90 | 90 | 90 | 90 | 90 | 90 | 90 | 90 | 90 | 90 | 90 | 90 | 90 | 90 | 90 | 90 |
| | Pressure/kPa | 433 | 433 | 433 | 433 | 433 | 433 | 433 | 433 | 433 | 433 | 433 | 433 | 433 | 433 | 433 | 433 |
| | Rotational speed/rpm | 2500 | 2500 | 2500 | 2500 | 2500 | 2500 | 2500 | 2500 | 2500 | 2500 | 2500 | 2500 | 2500 | 2500 | 2500 | 2500 |

Then data collection is performed as follows: the friction coefficients of the starting/midpoint/endpoint of the last engagement of each stage are shown in Table 3; the coefficients of static friction under the condition of 4.37 rpm in the supplementary test after each stage are shown in Table 4; and the torque curves of the 1000th engagement are shown in Table 5.

TABLE 3

| Engagement times/time | Starting friction coefficient | | | | Midpoint friction coefficient (Coefficient of dynamic friction) | | | | Endpoint friction coefficient | | | |
|---|---|---|---|---|---|---|---|---|---|---|---|---|
| | Example 1 | Example 2 | Comparative Example 2 | Comparative Example 4 | Example 1 | Example 2 | Comparative Example 2 | Comparative Example 4 | Example 1 | Example 2 | Comparative Example 2 | Comparative Example 4 |
| 250 | 0.047 | 0.043 | 0.043 | 0.042 | 0.048 | 0.045 | 0.046 | 0.043 | 0.102 | 0.122 | 0.123 | 0.146 |
| 500 | 0.045 | 0.043 | 0.043 | 0.041 | 0.042 | 0.048 | 0.049 | 0.042 | 0.101 | 0.128 | 0.128 | 0.140 |
| 750 | 0.045 | 0.043 | 0.043 | 0.039 | 0.045 | 0.047 | 0.048 | 0.041 | 0.106 | 0.119 | 0.131 | 0.148 |
| 1000 | 0.046 | 0.043 | 0.043 | 0.039 | 0.046 | 0.047 | 0.046 | 0.043 | 0.106 | 0.128 | 0.131 | 0.150 |
| 1250 | 0.046 | 0.042 | 0.043 | 0.039 | 0.047 | 0.046 | 0.046 | 0.042 | 0.109 | 0.124 | 0.135 | 0.158 |
| 1500 | 0.046 | 0.042 | 0.042 | 0.038 | 0.049 | 0.047 | 0.045 | 0.041 | 0.109 | 0.127 | 0.131 | 0.152 |
| 1750 | 0.046 | 0.043 | 0.042 | 0.038 | 0.047 | 0.047 | 0.045 | 0.04 | 0.105 | 0.132 | 0.129 | 0.158 |
| 2000 | 0.045 | 0.041 | 0.045 | 0.037 | 0.047 | 0.044 | 0.044 | 0.043 | 0.103 | 0.128 | 0.125 | 0.167 |
| 2250 | 0.046 | 0.046 | 0.044 | 0.037 | 0.048 | 0.045 | 0.043 | 0.041 | 0.106 | 0.123 | 0.133 | 0.172 |
| 2500 | 0.046 | 0.044 | 0.043 | 0.035 | 0.047 | 0.044 | 0.044 | 0.039 | 0.105 | 0.125 | 0.132 | 0.174 |
| 2750 | 0.045 | 0.044 | 0.043 | 0.035 | 0.047 | 0.046 | 0.042 | 0.039 | 0.107 | 0.124 | 0.127 | 0.151 |
| 3000 | 0.045 | 0.043 | 0.043 | 0.035 | 0.048 | 0.046 | 0.044 | 0.04 | 0.104 | 0.127 | 0.135 | 0.158 |
| 3250 | 0.045 | 0.043 | 0.043 | 0.035 | 0.047 | 0.043 | 0.045 | 0.04 | 0.104 | 0.123 | 0.130 | 0.151 |
| 3500 | 0.045 | 0.043 | 0.042 | 0.034 | 0.047 | 0.045 | 0.045 | 0.039 | 0.103 | 0.121 | 0.131 | 0.151 |
| 3750 | 0.044 | 0.042 | 0.042 | 0.034 | 0.047 | 0.046 | 0.047 | 0.037 | 0.110 | 0.124 | 0.130 | 0.149 |
| 4000 | 0.043 | 0.042 | 0.042 | 0.033 | 0.046 | 0.045 | 0.046 | 0.038 | 0.105 | 0.130 | 0.135 | 0.149 |

TABLE 4

| Engagement times/time | Coefficient of static friction | | | | Midpoint friction coefficient/ Endpoint friction coefficient | | | |
|---|---|---|---|---|---|---|---|---|
| | Example 1 | Example 2 | Comparative Example 2 | Comparative Example 4 | Example 1 | Example 2 | Comparative Example 2 | Comparative Example 4 |
| 250 | 0.104 | 0.12 | 0.122 | 0.137 | 2.13 | 2.71 | 2.68 | 3.39 |
| 500 | 0.103 | 0.12 | 0.121 | 0.138 | 2.40 | 2.67 | 2.61 | 3.33 |
| 750 | 0.101 | 0.118 | 0.122 | 0.139 | 2.36 | 2.54 | 2.73 | 3.60 |
| 1000 | 0.099 | 0.118 | 0.123 | 0.141 | 2.31 | 2.72 | 2.85 | 3.48 |
| 1250 | 0.098 | 0.117 | 0.123 | 0.14 | 2.32 | 2.70 | 2.94 | 3.77 |
| 1500 | 0.099 | 0.12 | 0.122 | 0.141 | 2.22 | 2.71 | 2.91 | 3.71 |
| 1750 | 0.098 | 0.119 | 0.123 | 0.14 | 2.22 | 2.80 | 2.86 | 3.95 |
| 2000 | 0.100 | 0.118 | 0.122 | 0.142 | 2.19 | 2.90 | 2.83 | 3.89 |

TABLE 4-continued

| Engagement times/time | Coefficient of static friction | | | | Midpoint friction coefficient/ Endpoint friction coefficient | | | |
|---|---|---|---|---|---|---|---|---|
| | Example 1 | Example 2 | Comparative Example 2 | Comparative Example 4 | Example 1 | Example 2 | Comparative Example 2 | Comparative Example 4 |
| 2250 | 0.097 | 0.116 | 0.12 | 0.142 | 2.20 | 2.74 | 3.09 | 4.20 |
| 2500 | 0.099 | 0.115 | 0.121 | 0.142 | 2.23 | 2.83 | 3.00 | 4.47 |
| 2750 | 0.097 | 0.117 | 0.12 | 0.141 | 2.27 | 2.70 | 3.03 | 3.87 |
| 3000 | 0.096 | 0.116 | 0.122 | 0.142 | 2.17 | 2.77 | 3.07 | 3.95 |
| 3250 | 0.096 | 0.116 | 0.122 | 0.142 | 2.20 | 2.87 | 2.89 | 3.77 |
| 3500 | 0.097 | 0.116 | 0.123 | 0.143 | 2.20 | 2.70 | 2.91 | 3.87 |
| 3750 | 0.095 | 0.115 | 0.123 | 0.142 | 2.33 | 2.71 | 2.76 | 4.04 |
| 4000 | 0.096 | 0.116 | 0.123 | 0.141 | 2.29 | 2.88 | 2.94 | 3.93 |

From the data in Table 3 and Table 4, it can be seen that the midpoint friction coefficients of Example 1 and Example 2 are generally higher, and are most obvious when engaged 1500-3000 times. Taking the 2500th engagement as an example, the midpoint friction coefficient of Example 1 is 0.047, the midpoint friction coefficient of Example 2 is 0.044, the midpoint friction coefficient of Comparative Example 2 is 0.044, and the midpoint friction coefficient of Comparative Example 4 is 0.039. Example 1 and Example 2 show a higher coefficient of dynamic friction, meaning that more efficient torque transmission can be provided, and the workload and efficiency can be improved.

Example 1 has not only a higher midpoint friction coefficient, but also a lower endpoint friction coefficient, which is more obvious during the 2500th engagement. At this time, the endpoint friction coefficient of Example 1 is 0.105, the endpoint friction coefficient of Example 2 is 0.125, the endpoint friction coefficient of Comparative Example 2 is 0.132, and the endpoint friction coefficient of Comparative Example 4 is 0.174. The smaller the ratio of the endpoint friction coefficient to the midpoint friction coefficient, the better it is for improving the smoothness of the engagement. Example 1 and Example 2 have a higher midpoint friction coefficient on the one hand and a lower endpoint friction coefficient on the other hand, which is ultimately reflected in a lower endpoint/midpoint friction coefficient ratio and a significant improvement.

TABLE 5

| Group | Maximum torque during engagement/N · m |
|---|---|
| Example 1 | 279.8 |
| Example 2 | 337.1 |
| Example 3 | 341.0 |
| Example 4 | 293.6 |
| Example 5 | 308.8 |
| Example 6 | 284.2 |
| Example 7 | 289.7 |
| Example 8 | 301.8 |
| Example 9 | 313.2 |
| Example 10 | 326.3 |
| Example 11 | 312.6 |
| Example 12 | 334.9 |
| Comparative Example 1 | 352.4 |
| Comparative Example 2 | 346.4 |
| Comparative Example 3 | 401.5 |
| Comparative Example 4 | 397.3 |

From the data in Table 5, it can be seen that the maximum torque of Example 1 during the engagement is relatively small, 279.8 N·m; the maximum torque of Comparative Example 4 during the engagement is relatively large, 397.3 N·m; and the maximum torque of Example 1 is 30% lower than that of Comparative Example 4. The greater the maximum torque of the clutch during the engagement, the greater the heat generation, and the greater the impact on lubricating oils, materials, and seals. Effective reduction of the maximum torque can extend the service life of the components to a certain extent. It can be seen from Example 1 to Example 2 that the linear alkane-modified sulfonated graphene can all play a role in reducing the maximum torque. The modified graphene with different carbon and sulfur mass ratios has different effects on reducing the maximum torque, wherein the modification effect is better when the carbon and sulfur mass ratio is in the range of 16-32. Comparative Example 1 and Comparative Example 3 did not show the effect of reducing the maximum torque, which may be related to the type of graphene and dispersion stability.

(2.3) Evaluation of the Traction Force of the Complete Machine

The products of Examples 1-2, Comparative Example 2 and Comparative Example 4 are tested for traction force in the same loader. The test method is: GB/T 6375-2008 Earth-moving Machinery—Method of test for the measurement of drawbar pull to test the static maximum traction force. The results are shown in Table 6. The results show that within the test error range, there is no significant difference in the maximum traction force between Example 1 and Comparative Example 2, and between Example 2 and Comparative Example 4 for F1 and F2 gears, indicating that the lubricating oil involved in the present disclosure has the advantage of reducing the static and terminal friction coefficients without reducing the traction force.

TABLE 6

| | F1 gear maximum traction force /KN | F2 gear maximum traction force/KN |
|---|---|---|
| Example 1 | 139.6 | 40.3 |
| Example 2 | 139.8 | 40.5 |
| Comparative Example 2 | 140.2 | 40.0 |
| Comparative Example 4 | 140.1 | 41.5 |

(3) Evaluation of Anti-Wear Performance

The anti-wear properties of the products of Examples 1-12 and Comparative Examples 1-4 are evaluated in the following aspects.

(3.1) A four-ball friction testing machine (Xiamen Tenkey Automation Co., Ltd.) is used to test the wear scar diameters (mm) under the conditions of 392 N, 100 r/min, 10 min, and the results are shown in Table 7.

TABLE 7

| Group | Wear scar diameter (mm) | Percentage of wear scar diameter change |
|---|---|---|
| Example 1 | 0.35 | −5.4% |
| Example 2 | 0.32 | −8.6% |
| Example 3 | 0.37 | 0.0% |
| Example 4 | 0.35 | −5.4% |
| Example 5 | 0.35 | −5.4% |
| Example 6 | 0.35 | −5.4% |
| Example 7 | 0.35 | −5.4% |
| Example 8 | 0.35 | −5.4% |
| Example 9 | 0.36 | −2.7% |
| Example 10 | 0.37 | 0.0% |
| Example 11 | 0.35 | −5.4% |
| Example 12 | 0.33 | −5.7% |
| Comparative Example 1 | 0.40 | 8.1% |
| Comparative Example 2 | 0.37 | / |
| Comparative Example 3 | 0.37 | 5.7% |
| Comparative Example 4 | 0.35 | / |

From the data in Table 7, it can be seen that most of Examples 1-12 show some degree of wear scar reduction, but Example 3 and Example 10 do not show this phenomenon, which may also be related to the dispersion stability of the modified graphene. Example 1 and Example 3 show a slight increase in wear scars, which may be related to the type of graphene and the dispersion stability.

(3.2) Simulation bench test, the test method is: the gearbox simulates the complete machine working conditions according to F1 neutral R1 neutral F1 neutral as a work cycle, to achieve the clutch engagement and disengagement, and the test lasts for 240 h. There are two main differences between the simulation bench test and the complete machine working condition, one is that the simulation bench always works under the maximum load, while the actual working conditions are not always under the maximum load; the second is that the engagement and disengagement of the simulation bench clutch is more frequent and continuous, so it is more severe than the actual working conditions. The content of elemental iron and elemental copper (ASTM D5185) at 0.5 h, 120 h and 240 h are detected and the results are shown in Table 8. The results in Table 8 show that Example 1 has relatively low contents of elemental Fe and elemental Cu compared with Comparative Example 2; and Example 2 also has the same effect compared with Comparative Example 4. In general, Example 1 and Example 2 can reduce the wear of iron and copper, especially copper.

TABLE 8

| | Fe | | | Cu | | |
|---|---|---|---|---|---|---|
| Group | 0.5 h | 120 h | 240 h | 0.5 h | 120 h | 240 h |
| Example 1 | 1 | 2 | 8 | 1 | 4 | 6 |
| Example 2 | 2 | 5 | 8 | 1 | 7 | 10 |
| Comparative Example 2 | 3 | 8 | 8 | 2 | 6 | 8 |

TABLE 8-continued

| | Fe | | | Cu | | |
|---|---|---|---|---|---|---|
| Group | 0.5 h | 120 h | 240 h | 0.5 h | 120 h | 240 h |
| Comparative Example 4 | 3 | 6 | 9 | 2 | 10 | 16 |

The iron spectrum analysis of Example 1, Comparative Example 2 and Comparative Example 4 are shown in FIG. 1 (a, b, and c correspond to the products of Example 1, Comparative Example 2, and Comparative Example 4, respectively, and the scale is 100 μm). It can be seen from the figure that there are a large number of ferromagnetic particles and copper particles in the used oil of No. 8 hydraulic transmission oil of 240 h; obvious copper particles (those particles that reflect yellow light) appear in the used oil of HM-46 hydraulic oil of 240 h; and the hydraulic oil of Example 1 has only a small number of ferromagnetic particles, sludge, and dust aggregates. The results show that the lubricating oil in the present disclosure significantly reduces the wear of copper and iron, especially the wear of copper.

(3.3) Reliability test of the complete machine. For the product of Example 1, ASTM D8184 is used to test the PQ of the used oil, GB/T 265 is used to test the kinematic viscosity change rate of the used oil at 100° C., and ASTM D5185 is used to test the wear amount (mg/kg) of iron and copper of the used oil. The results are shown in Table 9.

TABLE 9

| Used oil analysis index | PQ | Kinematic viscosity change rate at 100° C. | Wear amount of iron (mg/kg) | Wear amount of copper (mg/kg) |
|---|---|---|---|---|
| Testing method | ASTM D8184 | GB/T 265 | ASTM D5185 | ASTM D5185 |
| Comparative Example 4 (790 h) | 15 | −22% | 55 | 274 |
| Example 1 (800 h) | 11 | −10% | 24 | 59 |
| Example 1 (975 h) | 15 | −11% | 33 | 73 |
| Example 1 (1420 h) | 27 | −11% | 64 | 112 |

From the results in Table 9, it can be seen that for the same complete machine, the wear amount of Cu of 1420 h in Example 1 is 50% of that of 790 h in Comparative Example 4, and the viscosity change rate at 100° C. of 790 h in Comparative Example 4 is as high as −22%, while the viscosity change rate of 1420 h in Example 1 is −11%, which once again confirms that the lubricating oil in the present disclosure significantly reduces the wear of Cu element and has the advantage of enhancing the smoothness of gear shifting, and meanwhile, it also can effectively reduce the wear of Fe element, which has obvious anti-wear and anti-friction advantages.

(4) The linear docosyl-grafted sulfonated graphene added in Example 1 is characterized as follows.

Figure 2:
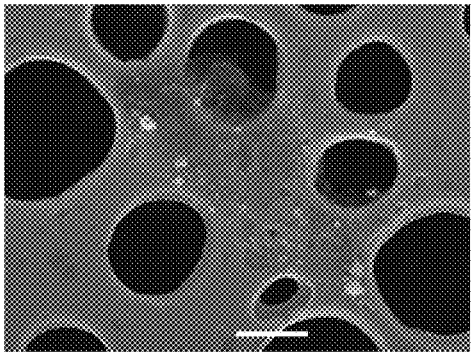
FIG. 2 is a scanning electron micrograph of the long carbon chain-grafted sulfonated graphene from Example 1.

(4.1) Scanning electron microscopy characterization, as shown in FIG. 2 (the scale is 2 μm), the figure shows that:

the modified graphene aggregates have a lamellar structure, with a lateral dimension of about 8 μm on the long side and 2 μm on the short side.

Figure 3:
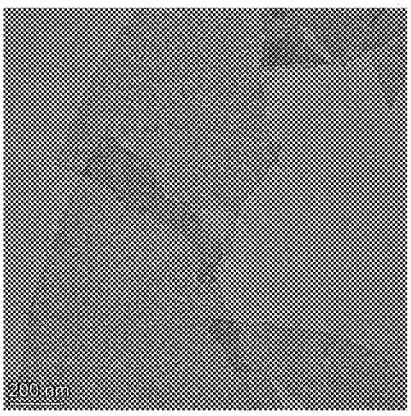
FIG. 3 is a transmission electron micrograph of the long carbon chain-grafted sulfonated graphene from Example 1.

(4.2) Transmission electron microscopy characterization, as shown in FIG. 3, shows that: the modified graphene flake layers are stacked in darker colors and there are slight folds on a single modified graphene flake layer. The lateral dimension of a single layer is about 400-1000 nm. It shows that TEM can better reflect the morphology of the modified graphene, and SEM more reflects the morphology of the aggregated state.

Figure 4:
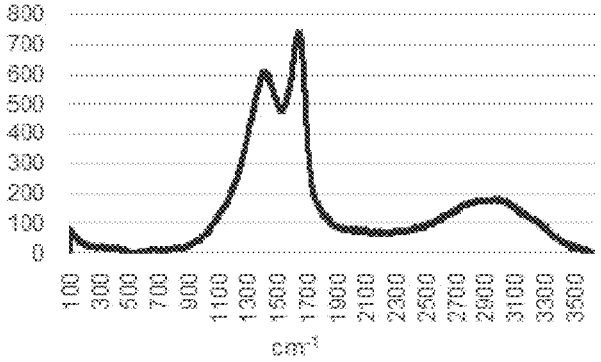
FIG. 4 is the Raman spectra of the long carbon chain-grafted sulfonated graphene in Example 1.

(4.3) Raman spectral analysis, as shown in FIG. 4, shows that: a sharp D peak appears at 1350 $cm^{-1}$, indicating the disorder of the lattice; a sharp G peak appears at 1580 $cm^{-1}$, indicating the stretching vibration of the $SP^2$ atomic pair; and a superimposed peak appears around 2700 $cm^{-1}$, presumably indicating around 5 layers of graphene (Reference here to the book "Graphene—Structure, Preparation Methods and Property Characterization" by Hongwei Zhu, Zhiping Xu, Dan Xie, etc.).

(4.4) Elemental analysis, the test method is SN/T3005-2011, the results show that the mass fraction of carbon in modified graphene powder is 70.46%, the mass fraction of sulfur is 3.01%, and the mass ratio of carbon to sulfur is 23.

The applicant declares that the present disclosure is illustrated by the above examples to illustrate an anti-wear, anti-friction and stably-dispersed lubricating oil or grease of the present disclosure and its preparation method, but the present disclosure is not limited to the above examples, i.e. it does not mean that the present disclosure must rely on the above examples to be implemented. It should be clear to those skilled in the art that any improvements of the present disclosure, equivalent substitutions of each raw material of the product of the present disclosure and the additions of auxiliary ingredients, the choices of specific methods, etc., fall within the scope of protection and disclosure of the present disclosure.

The above describes in detail the preferred embodiment of the present disclosure, however, the present disclosure is not limited to the specific details in the above embodiment, and a variety of simple variants of the technical solution of the present disclosure can be made within the technical concept of the present disclosure, and these simple variants fall within the scope of protection of the present disclosure.

In addition, it should be noted that each specific technical feature described in the above specific embodiment can be combined in any suitable way without contradiction, and in order to avoid unnecessary repetition, the present disclosure will not be described separately for various possible combinations.

What is claimed is:

1. An anti-wear, anti-friction and stably-dispersed lubricating oil or grease, comprising a main component of a lubricating oil or grease and a sulfonated graphene grafted with a long carbon chain, wherein the mass ratio of carbon element to sulfur element in the sulfonated graphene grafted with the long carbon chain is 15-50, and the number of carbon atoms in the long carbon chain is 10-50.

2. The anti-wear, anti-friction and stably-dispersed lubricating oil or grease according to claim 1, wherein the added mass of the sulfonated graphene grafted with the long carbon chain in the anti-wear, anti-friction and stably-dispersed lubricating oil or grease is 0.001-1%.

3. The anti-wear, anti-friction and stably-dispersed lubricating oil or grease according to claim 1, wherein the main component of the lubricating oil comprises a hydraulic transmission oil, a hydraulic oil, a gear oil or an engine oil.

4. The anti-wear, anti-friction and stably-dispersed lubricating oil or grease according to claim 3, wherein the hydraulic transmission oil is No. 8 hydraulic transmission oil or automatic transmission oil.

5. The anti-wear, anti-friction and stably-dispersed lubricating oil or grease according to claim 3, wherein the hydraulic oil is HM-46 hydraulic oil.

6. The anti-wear, anti-friction and stably-dispersed lubricating oil or grease according to claim 1, wherein the main component of the grease includes a calcium-based lubricating grease, a lithium-based lubricating grease, a complex lithium-based lubricating grease, a complex calcium-based lubricating grease, a polyurea, a silicone grease, or a fluorine grease.

7. A method for preparing the anti-wear, anti-friction and stably-dispersed lubricating oil or grease according to claim 1, wherein the preparation method comprises:

(1) dispersing a sulfonated graphene grafted with a long carbon chain in a base oil to produce a graphene additive; and (2) mixing the graphene additive produced in step (1) with a main component of a lubricating oil or grease to form a mixture, and stirring and dispersing the mixture to obtain an anti-wear, anti-friction and stably-dispersed lubricating oil or grease.

8. The method for preparing an anti-wear, anti-friction and stably-dispersed lubricating oil or grease according to claim 7, wherein the mass fraction of the sulfonated graphene in the graphene additive produced in step (1) is 0.1% to 10%.

9. The method for preparing an anti-wear, anti-friction and stably-dispersed lubricating oil or grease according to claim 7, wherein the dispersion process in step (1) comprises stirring dispersion or pulse dispersion with a dispersion time of 10-60 min and a stirring speed of 10-6000 r/min.

10. The method for preparing an anti-wear, anti-friction and stably-dispersed lubricating oil or grease according to claim 7, wherein the dispersion in step (2) comprises stirring dispersion, pulse dispersion or grinding dispersion, the dispersion time is 0.1-3 h, and the stirring speed is 10-3000 r/min.

* * * * *